US005441250A

United States Patent [19]

Kameyama et al.

[11] Patent Number: 5,441,250

[45] Date of Patent: Aug. 15, 1995

[54] SHEET FEEDING APPARATUS

[75] Inventors: Toru Kameyama, Tokyo; Toshiyuki Asakawa, Sagamihara, both of Japan

[73] Assignee: Canon Kabushiki Kaisha, Tokyo, Japan

[21] Appl. No.: 103,162

[22] Filed: Aug. 9, 1993

Related U.S. Application Data

[63] Continuation of Ser. No. 865,751, Apr. 10, 1992, abandoned, which is a continuation of Ser. No. 426,869, Oct. 26, 1989, abandoned.

[30] Foreign Application Priority Data

Oct. 31, 1988 [JP] Japan ..... 63-275393
Oct. 31, 1988 [JP] Japan ..... 63-275394
Oct. 31, 1988 [JP] Japan ..... 63-275395

[51] Int. Cl.[6] ..... B65H 3/52
[52] U.S. Cl. ..... 271/121
[58] Field of Search ..... 271/121, 124, 125, 2

[56] References Cited

U.S. PATENT DOCUMENTS 1,506,423 8/1924 Gray ..... 271/121
1,596,056 8/1926 Mader ..... 271/124
1,919,238 7/1933 McCarthy .
3,640,052 2/1972 Konoki et al. ..... 55/19
3,640,524 2/1972 Fredrickson .
3,900,192 8/1975 Gibson ..... 271/121 X
4,113,245 9/1978 Colglazier ..... 271/121 X
4,346,879 8/1982 Ruenzi ..... 271/121
4,364,551 12/1982 Rutishauser ..... 271/121
4,418,904 12/1983 Fujimoto ..... 271/37
4,718,809 1/1988 Krasuski ..... 271/121 X
4,844,437 7/1989 Tanaka ..... 271/124

FOREIGN PATENT DOCUMENTS 0234556 9/1987 European Pat. Off. .
3328872 2/1984 Germany .
8437890 5/1987 Germany .
295843 12/1987 Japan ..... 271/121

*Primary Examiner*—H. Grant Skaggs
*Attorney, Agent, or Firm*—Fitzpatrick, Cella, Harper & Scinto

[57] ABSTRACT

The present invention provides a sheet feeding apparatus with a feeding roller for feeding sheets; a friction member arranged at a position where a leading edge of the sheet fed by the feeding roller is abutted against the friction member and inclined with respect to a sheet feeding direction, the friction member being adapted to separate the sheets one by one by applying a friction force caused by contacting the leading edges of the sheets along lines to the sheets; and a guide member arranged at a same side as the friction member with respect to a sheet feeding path, and adapted to guide the leading edge of the sheet to a predetermined position on the friction member.

22 Claims, 13 Drawing Sheets

SHEET FEEDING APPARATUS

This application is a continuation of application Ser. No. 07/865,751 filed Apr. 10, 1992, now abandoned; which is a continuation application of Ser. No. 07/426,869 filed Oct. 26, 1989, now abandoned.

BACKGROUND OF THE INVENTION

1. Field of the Invention

The present invention relates to a sheet feeding apparatus used with an image forming system such as a copying machine, laser beam printer and the like, and more particularly, it relates to a sheet feeding apparatus having a feeding member (refer to as "feed roller" hereinafter) and a friction member (refer to as "separating pad" hereinafter).

2. Related Background Art

In the past, a sheet feeding apparatus having a feed roller and a separating pad has been known. In such conventional sheet feeding apparatus, the sheet is fed while frictionally contacting the sheet with the separating pad biased toward the feed roller, and the feeding of the next sheet is prevented by abutting the leading edge of the next sheet against the separating pad.

However, in the above-mentioned conventional sheet feeding apparatus, since the whole area from the leading edge to the trailing edge of the sheet being fed frictionally contacts the separating pad, the frictional resistance in the sheet feeding movement is increased to cause the premature wear of the feed roller, thus shortening the service life of the feed roller, and further, to cause the excessive wear of the separating pad, thereby worsening the sheet separation ability of the separating pad resulting in the double-feed of sheets.

Further, in order to handle thicker sheets or sheets hard to bend (or curl) such as cards or envelopes, sheet feeding apparatuses as disclosed in the U.S. Pat. Nos. 1,919,238 and 3,640,524 have been proposed. In such conventional sheet feeding apparatuses, a separating pad is arranged with a predetermined inclined angle with respect to a sheet feeding direction at a position where the leading edge of the sheet fed by a feed roller is abutted against the separating roller. Further, a sheet feeding force provided by the feed roller overcomes a force that the separating pad tends to retain the leading edge of the sheet, whereby the top sheet slips on the separating pad to separate therefrom, thus feeding the top sheet. On the other hand, the next and the other sheets are not subjected to a feeding force greater than a friction force between the sheets, and, accordingly, these sheets are prevented from being fed and are remain stationary in the condition that the leading edges of these sheets are abutted against the separating pad.

However, in the above-mentioned conventional sheet feeding apparatus of the type wherein the sheets are separated by abutting the leading edges of the sheets against the separating pad, if the leading edge portion of the sheet is curled to increase an angle $\theta$ between the leading edge of the sheet and the separating pad as shown in FIG. 18, the friction force between the leading edge of the sheet and the separating pad will be greater than the friction force between the sheet and the feed roller, with the result that the feed roller frequently slips on the sheet to prevent the feeding of the sheet.

SUMMARY OF THE INVENTION

An object of the present invention is to provide a sheet feeding apparatus designed so that, if the sheet is curled, a leading edge of the sheet being fed abuts against a separating pad (friction member) at a predetermined angle, thereby separating and feeding the sheet positively.

In order to achieve the above object, the present invention provides a sheet feeding apparatus including a feeding member (feed roller) for feeding a sheet and a friction member (separating pad) against which a leading edge of the sheet being fed by the feeder is abutted and adapted to separate the sheets one by one, the sheet feeding apparatus being characterized in that the friction member is arranged at a predetermined distance from the feeder and is inclined at a predetermined angle with respect to a sheet feeding direction, and that a low friction member is arranged at an upstream side of the aforementioned friction member in the sheet feeding direction.

With this arrangement, the leading edge of the sheet fed by the feeder is abutted against the friction member, thereby separating the sheets one by one. If the leading edge of the sheet fed by the feeder is curled, the curled leading edge of the sheet is abutted against the low friction member, by which the sheet is fed toward the friction member (separating pad).

DETAILED DESCRIPTION OF THE PREFERRED EMBODIMENTS

The present invention will now be explained in connection with embodiments thereof with reference to the accompanying drawings.

Figure 1:
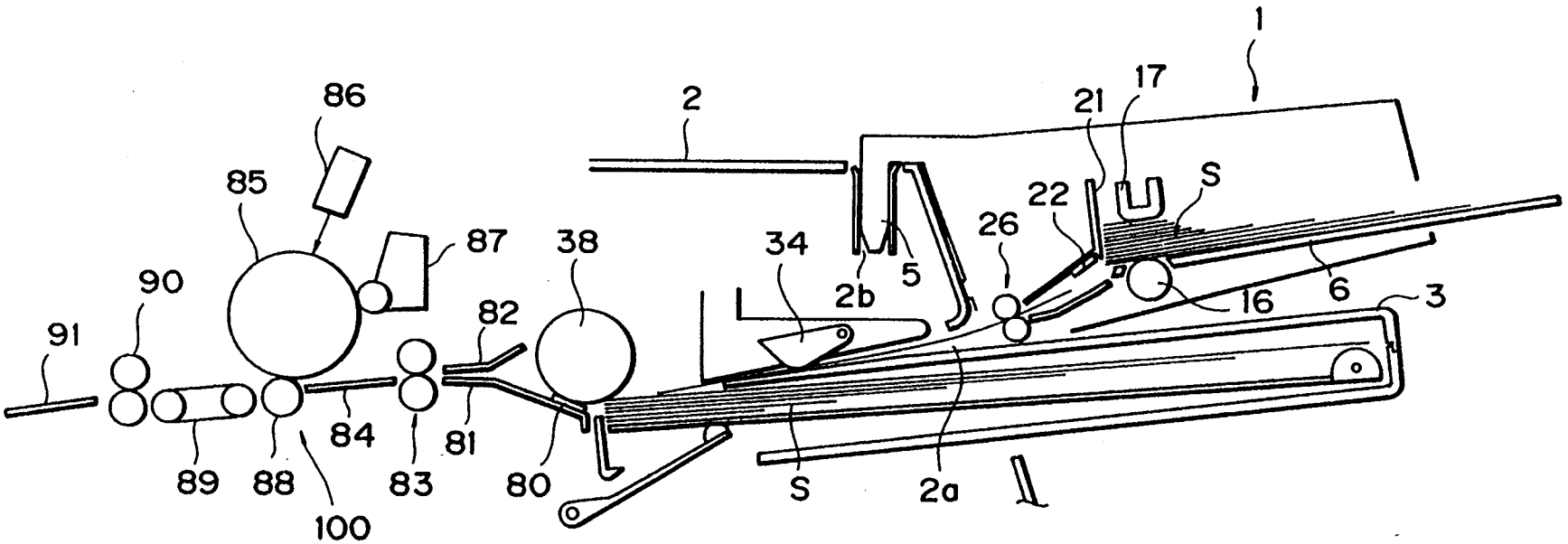
FIG. 1 is an elevational sectional view of a sheet feeding apparatus according to a preferred embodiment of the present invention.
Figure 2:
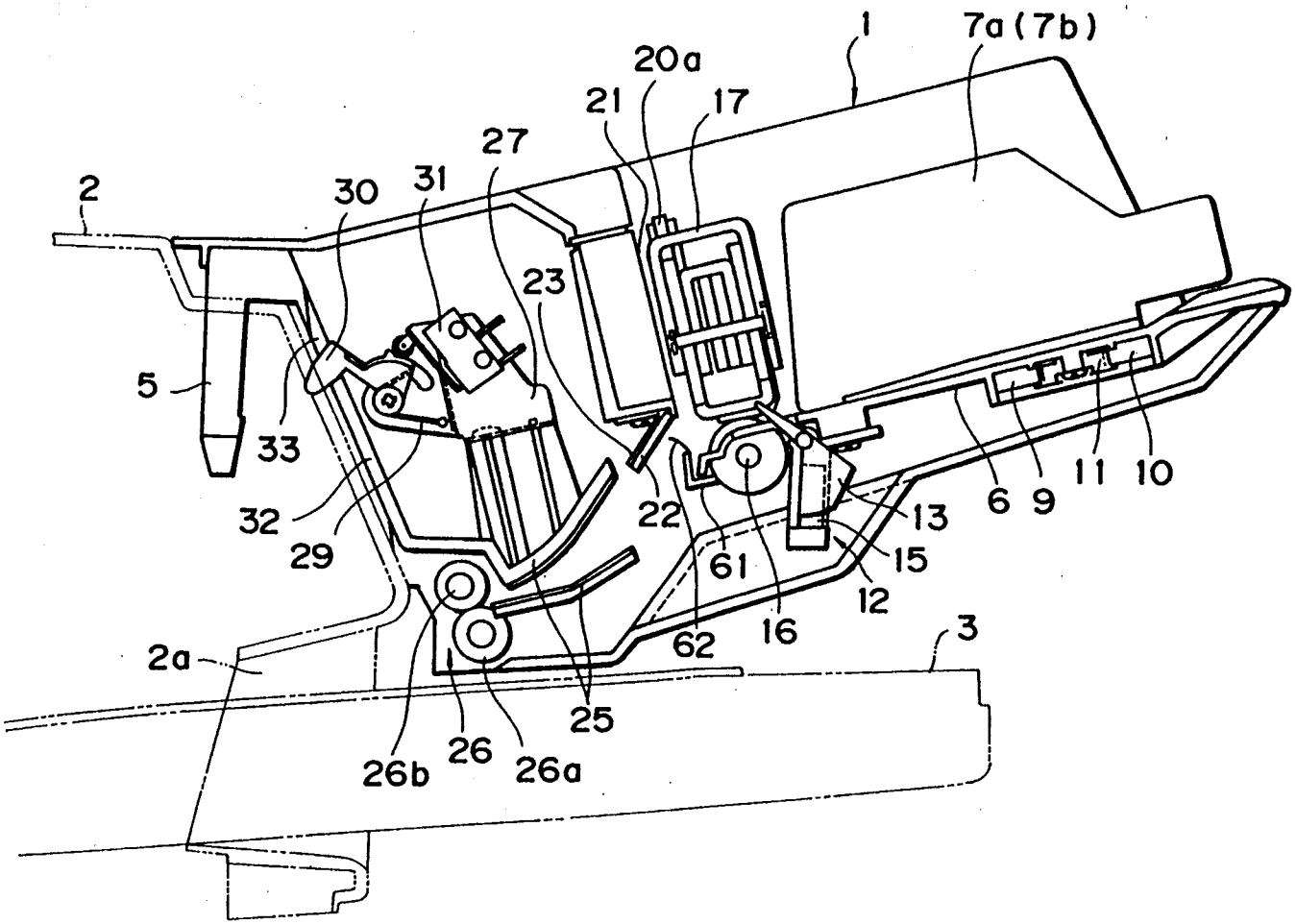
FIG. 2 is an enlarged sectional view of a main portion of the apparatus of FIG. 1.
Figure 3:
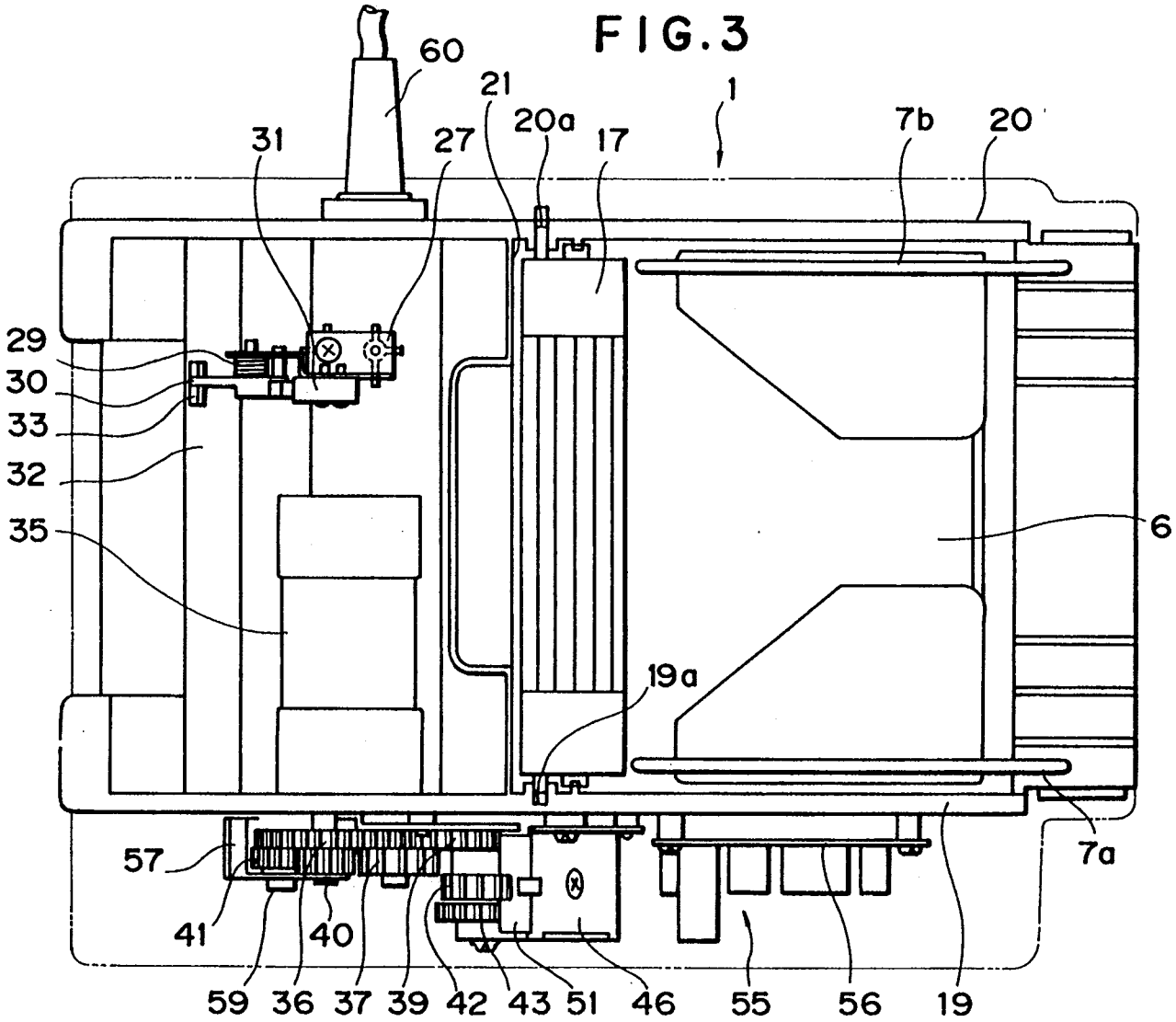
FIG. 3 is a plan view of the main portion of FIG. 2.

As shown in FIGS. 1 to 3, a sheet feeding apparatus 1 is mounted on a side of a laser beam printer 2 above a cassette 3 removably loaded on the side of the laser beam printer 2. The sheet feeding apparatus 1 is adapted to be positioned by inserting positioning pins 5 formed on a base end of the apparatus into corresponding holes 2b formed in the laser printer 2. A manual sheet insertion opening 2a for feeding the sheet manually is provided above the cassette 3. Further, the sheet feeding apparatus 1 includes a sheet feed supply tray 6 for supporting the thicker sheets such as envelopes, which tray 6 has regulating plates 7a, 7b for regulating the transverse movement of the sheets.

The regulating plates 7a and 7b are provided at their lower portions with racks 9 and 10, respectively, which are engaged by a pinion gear 11. By rotating the pinion gear 11, the regulating plates can be shifted toward and away from each other in the transverse direction. A sheet presence sensor 12 for detecting the presence of the sheet is arranged on the supply tray 6, which sensor 12 comprises a sensor lever 13 which can be rocked by abutting against the sheet, and a photo-interrupter 15 which can be turned ON or OFF by the sensor lever 13.

At a downstream side of the sensor 12, a feed roller 16 is rotatably supported to feed the sheet from the supply tray 6 by engaging with the undersurface of the sheet. Above the feed roller 16, a weight 17 is supported for movement in an up-and-down direction, which weight is guided by recesses 19a, 20a formed in side plates 19, 20 to press the sheets against the feed roller 16. Further, a leading edge regulating member 21 for regulating leading edges of the sheets supplied to the supply tray 6 is arranged in the vicinity of the weight 17. Between a lower end of the regulating member 21 and a downstream end of the supply tray 6, there is a predetermined gap, through which the sheet can be supplied.

Figure 4:
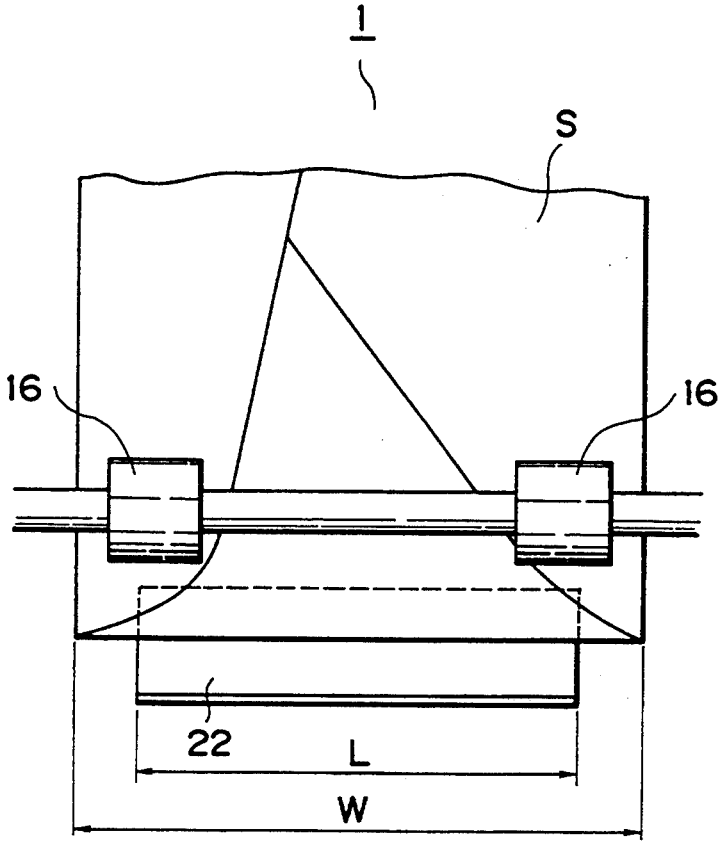
FIG. 4 is an explanatory view showing a friction member of the sheet feeding apparatus.

A separating pad 22 constituted by a high friction member made of rubber and the like is fixedly mounted on a lower portion of the leading edge regulating member 21 through an attachment plate 23. The separating pad 22 is separated from the feed roller 16 by a predetermined distance and is inclined with respect to a sheet feeding direction by a predetermined angle. A width (L) of the separating pad 22 is narrower than a width (W) of the sheet (refer to FIG. 4).

A pair of guides 25 for guiding the sheet are arranged at a downstream side of the separating pad 22, and a pair of feeding rollers 26 comprising a drive roller 26a and a pinch roller 26b are arranged at a downstream side of the paired guides 25. Further, above the paired rollers 26, there is provided a bracket 27, on which a lever 30 and a microswitch 31 are arranged. The lever 30 is rotatably supported by the bracket 27 and is biased toward an anti-clockwise direction by means of a bias spring 29, and the microswitch 31 can be turned ON or OFF by the lever 30. One end of the lever 30 projects from a hole 33 formed in a frame 32, so that, when the sheet feeding apparatus 1 is mounted on the laser beam printer 2, said one end of the lever is abutted against and pressed by the printer 2, thereby rocking the lever 30 in a clockwise direction to turn the microswitch 31 ON.

Further, at a downstream side of the manual sheet insertion opening 2a of the laser beam printer 2, there is provided a sheet presence sensor 34 for detecting the sheet being fed from the sheet feeding apparatus 1. A feed roller 38 for feeding the sheet from the cassette 3 is arranged at a downstream side of the sensor 34.

Figure 5:
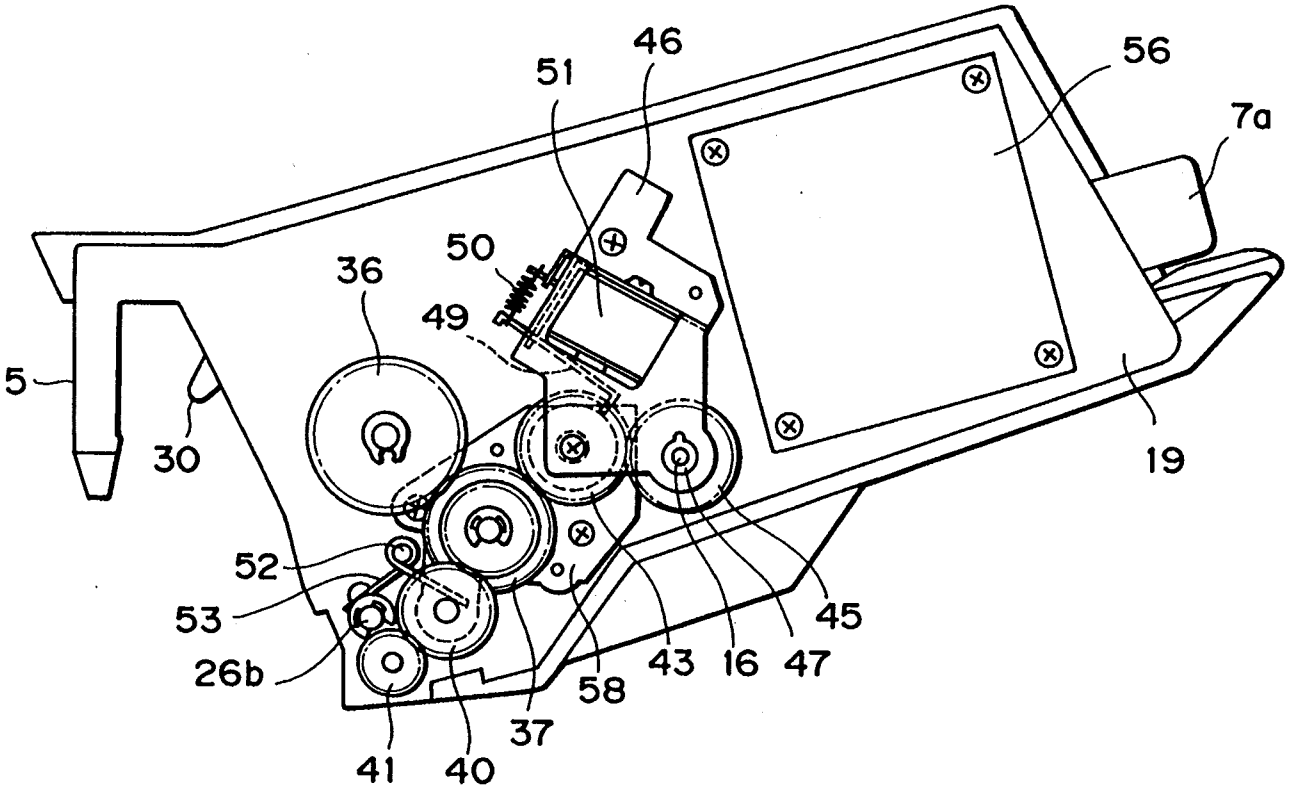
FIG. 5 is a plan view showing a driving system of the sheet feeding apparatus.

As shown in FIGS. 3 and 5, a motor 35 is fixed to the side plate 19, which motor 35 has a motor shaft having an output gear 36 fixed thereto. The output gear 36 is meshed with a larger diameter gear portion of a dual gear 37. The larger diameter portion is in turn meshed with a gear 39, and a smaller diameter portion of the dual gear 37 is meshed with a gear 40. The gear 40 is meshed with a gear 41 fixed to a shaft of the drive roller 26a of the paired feeding rollers 26. In this way, a driving force from the motor 35 is transmitted to the gear 41, and, accordingly the drive roller 26a.

Further, the gear 39 is connected to a gear 43 through a spring clutch 42, which gear 43 is meshed with a drive gear 45 supported by and connected to a shaft of the feed roller 16 through a one-way clutch. Accordingly, the driving force from the motor 35 is transmitted to the gear 45. In the vicinity of the gear 45, there is provided a bracket 46 to which the shaft of the feed roller 16 is connected through a metallic bearing 47, thus earthing the feed roller 16.

A lever 49 for locking the spring clutch 42 is rockably supported by the bracket 46. One end of the lever 49 is connected to one end of a spring 50 the other end of which is connected to the bracket 46. In this way, the lever 49 is biased toward a clockwise direction. Further, a Solenoid 51 arranged on the bracket 46 is adapted to attract or release the lever 49.

On the other hand, a projection 52 is formed on the side plate 19 in the vicinity of gear 40, and a spring 53 is supported by the projection 52. One end of the spring 53 abuts against the shaft of the gear 40, and the other end of the spring 53 abuts against a shaft of the pinch roller 26b to urge the latter against the drive roller 26a. Further, a base plate 56 on which a controller 55 is mounted is arranged on the side plate 19. The controller 55 controls the motor 35 and the solenoid 51, and receives and transmits a signal with respect to the laser beam printer 2.

Further, on the side plate 19 there is provided a support member 58 which supports the shafts of the gears 37, 40, 43 and is connected to the bracket 46 through the shaft of the gear 43, thereby earthing the bracket 46. Incidentally, the reference numeral 57 designates a cover for the gear 41, which cover 57 is fixed to the shaft of the gear 40 by means of pins. Further, the cover 57 is connected to the shaft of the drive roller 26a through a metallic bearing 59, thereby earthing the drive roller 26a. Incidentally, the reference numeral 60 designates a cable electrically connected to the laser beam printer 2.

Figure 6:
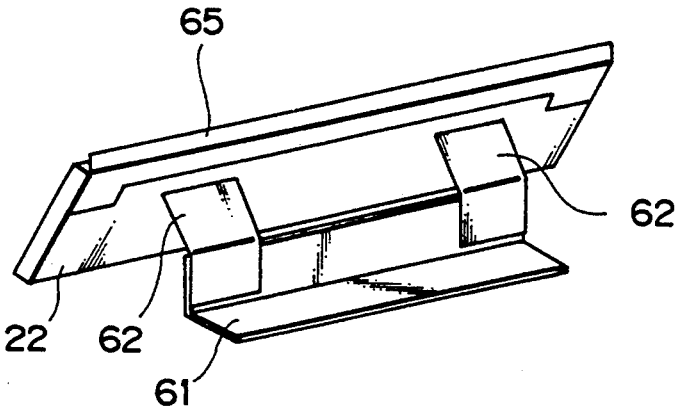
FIG. 6 is a perspective view of a pressure means of the sheet feeding apparatus.
Figure 7:
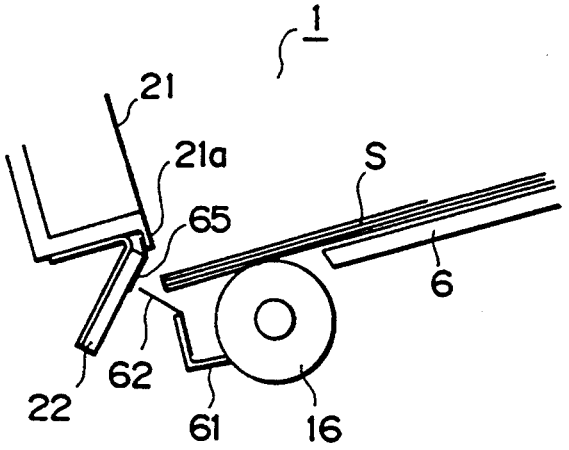
FIG. 7 is a sectional view of the pressure means.

As shown in FIGS. 6 and 7, the sheet feeding apparatus 1 has a supporting plate 61 arranged in the vicinity of the feed roller 16, and a lamina 62 made of flexible material such as polyester film and the like is fixed to the supporting plate 61 at its base end.

Figure 8A:
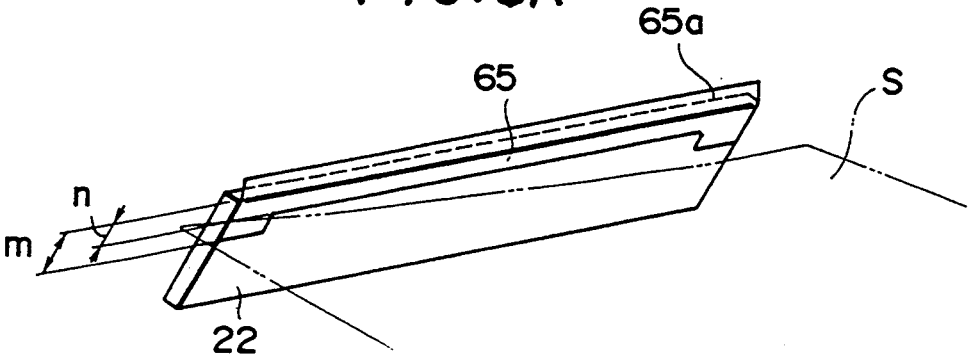
FIG. 8A is a perspective view of the friction member.
Figure 8B:
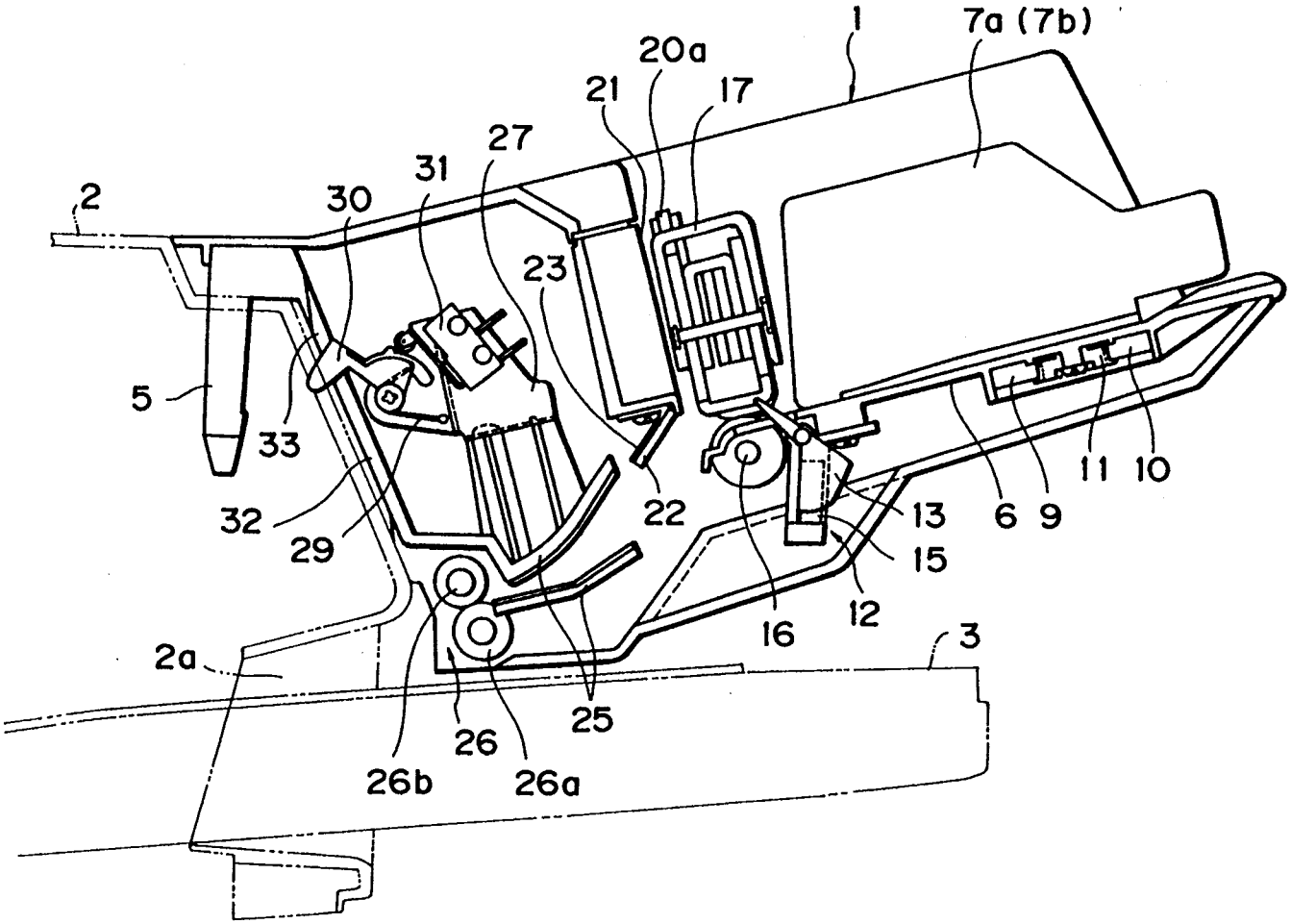
FIG. 8B is a sectional view of the sheet feeding apparatus.
Figure 9:
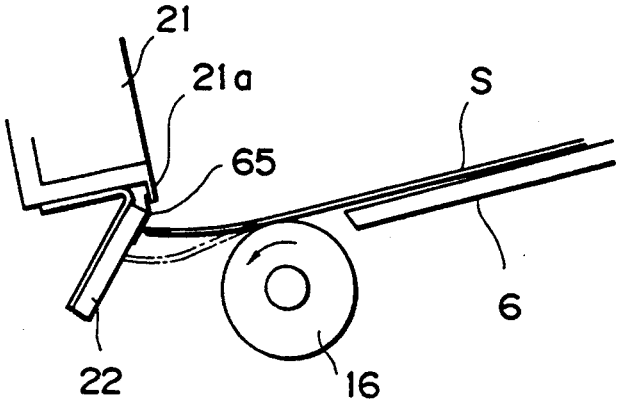
FIG. 9 is an explanatory view for explaining the operation of the friction member.

Further, as shown in FIGS. 8 and 9, a low friction sheet member 65 made of low friction material such as polyester sheet material is adhered to an upper end of the separating pad 22. The sheet member 65 has a central portion narrower than both end portions (along the width thereof). When the sheet is skew-fed or when the sheet being fed is twisted, although one corner of the leading edge strikes against the one end portion of the separating pad 22, since there is the wider end portion of the low friction sheet member 65, said one end portion of the separating pad is not subjected to a large force by the sheet. Further, an upper end portion 65*a* of the sheet member 65 is abutted against a back surface of a lower end portion 21*a* of the leading edge regulating member 21, whereby the sheet S tending to penetrate between the lower end portion 21*a* and the separating pad 22 is guided downwardly by the sheet member 65.

As shown in FIG. 1, the laser beam printer comprises a feed roller 38 for feeding out the sheet housed in the cassette 3, and a separating pad 80 pressed against the feed roller 38 by means of a spring and adapted to separate the top sheet from the other sheets by stopping the other sheets. The reference numerals 81, 82 designate feeding guides, and 83 designates a pair of regist rollers. In a stopped condition, the nip between the regist rollers receives the sheet S being fed to eliminate the skew-feed of the sheet; then, the regist rollers are rotated to feed the sheet at a timing synchronous with an image formed on a photosensitive drum 85. The laser beam printer further comprises an image forming portion 100, a scanner 86 for forming a latent image on the photosensitive drum 100 by illuminating laser light on the latter, a developing device 87 for developing the latent image formed on the photosensitive drum to create a toner image, a transfer roller 88 for transferring the toner image formed on the photosensitive drum 85 onto the sheet S, a fixing roller 90 for fixing the transferred toner image to the sheet, and an ejector tray 91 for receiving the ejected sheet. The reference numeral 84 designates a guide for guiding the sheet from the pair of regist rollers 83 to the photosensitive drum 85, and 89 designates a belt conveyor for conveying the sheet from the photosensitive drum 85 to the fixing roller 90.

In operation, when the sheet feed signal is transmitted from the laser beam printer 2 to the controller 55, the latter activates the motor 35. The driving force from the motor 35 is transmitted to the drive roller 26*a* through the gears 36, 37, 40 and 41, thus rotating the drive roller. Of course, the pinch roller 26*b* is also rotated in response to the rotation of the drive roller 26*a*. Further, the driving force from the motor 35 is also transmitted to the spring clutch 42 through the gears 36, 37 and 39. However, in this point, since the spring clutch 42 is locked by the lever 49, the driving force is not transmitted to the feed roller 16. When a predetermined time period ($T_1$) is elapsed after the sheet feed signal is transmitted to the controller 55, the latter turns the solenoid 51 ON, whereby the lever 49 is attracted by the solenoid.

Consequently, the spring clutch 42 is released from the lever 49, thus transmitting the driving force (the rotation of the gear 39) to the gear 43. Then, the rotation of the gear 43 is transmitted to the drive gear 45 to rotate the same in an anti-clockwise direction. When the drive gear 45 is rotated in the anti-clockwise direction, the one-way clutch becomes a connecting condition, thereby rotating the feed roller 16 in an anti-clockwise direction. Further, the sheets S stacked on the supply tray 6 (the leading edges of the sheets S are registrated with each other by abutting against the leading edge regulating member 21 and the lateral movement of the sheets S is regulated by the regulating plates 7*a*, 7*b*) are fed out by the feed roller 16 one by one from the bottom.

Figure 10:
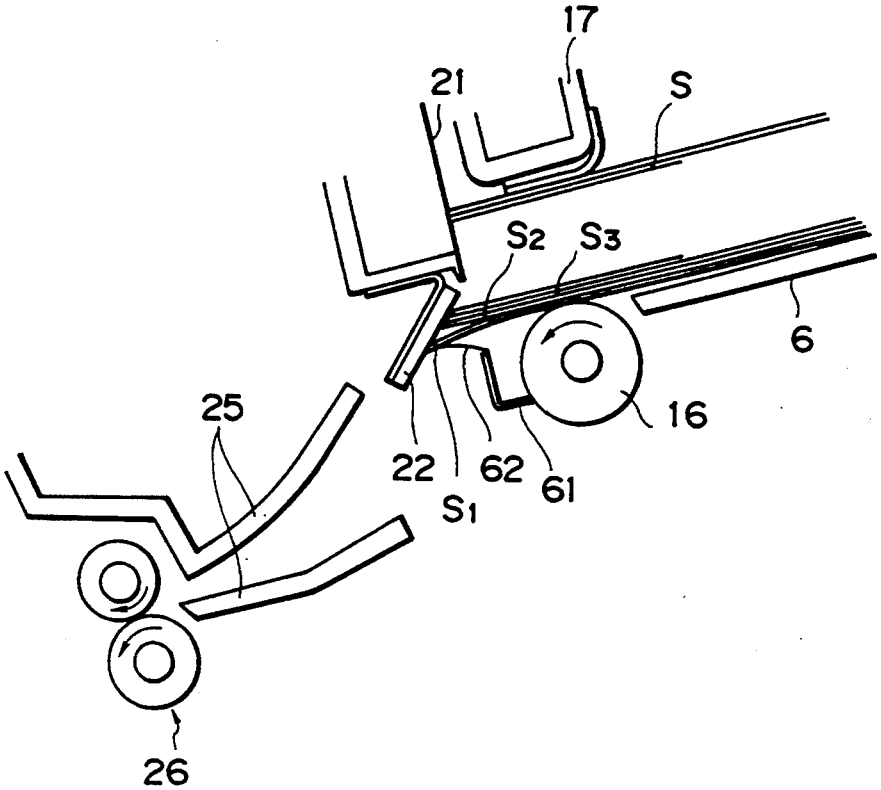
FIGS. 10 and 11 are explanatory views for explaining the operation of the pressure means.
Figure 11:
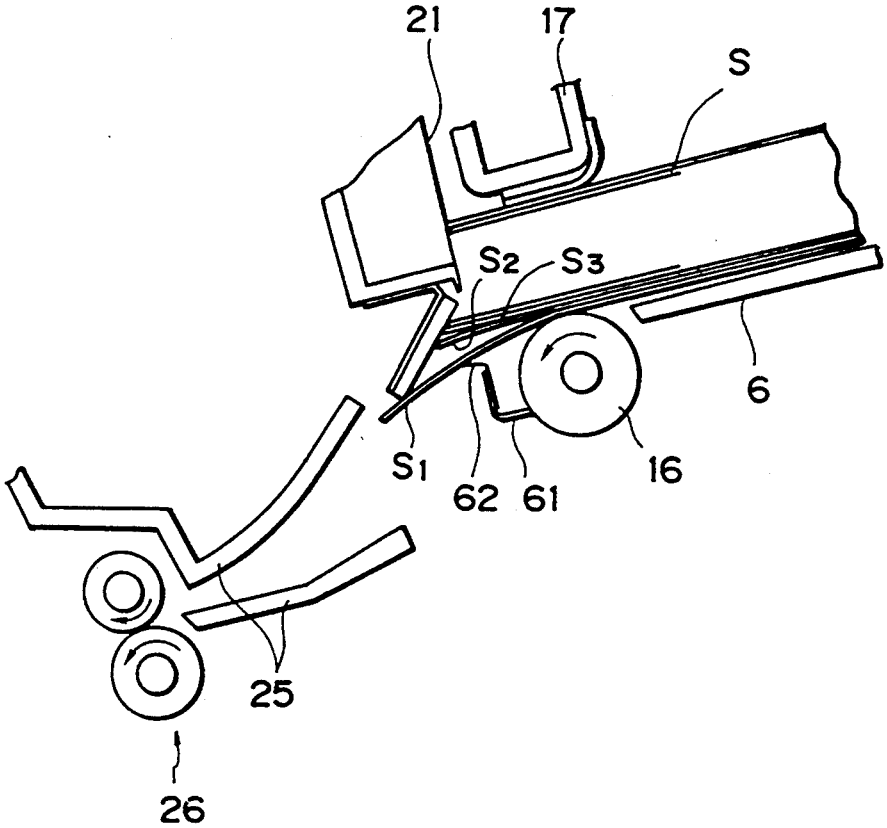

In this case, the sheets S stacked on the supply tray 6 are pressed against the feed roller 16 by the weight 17, thereby increasing the friction force between the feed roller 16 and the sheet S to enhance a feeding force of the feed roller 16. The leading edges of the sheet $S_1$, $S_2$, $S_3$, . . . fed by the feed roller 16 are abutted against the separating pad 22 to contact the latter along lines, respectively. Then, only the lowermost sheet $S_1$ is fed while shifting on the separating pad in a condition that the leading edge thereof remains to contact the separating pad along the line, since the feeding force of the feed roller 16 overcomes the friction force between the separating pad and the leading edge of the sheet (refer to FIGS. 10 and 11). In this case, the lamina 62 is flexed downwardly by the sheet $S_1$.

The lamina 62 lifts up the sheets $S_2$, $S_3$ by its reaction force to prevent the advance movement of the sheets $S_2$, $S_3$ and to help the separation of the sheet $S_1$ from the other sheets. In this way, the sheets can be securely separated even if the sheet are not hard to bend.

Figure 12A:
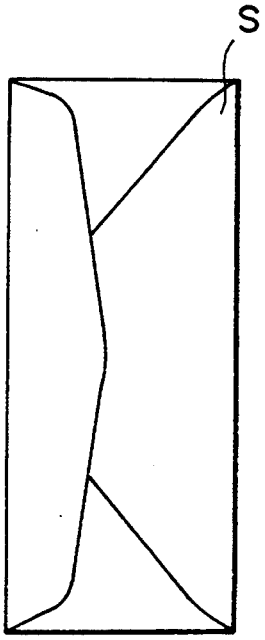
FIGS. 12A and 12B are explanatory views showing an envelope.
Figure 12B:
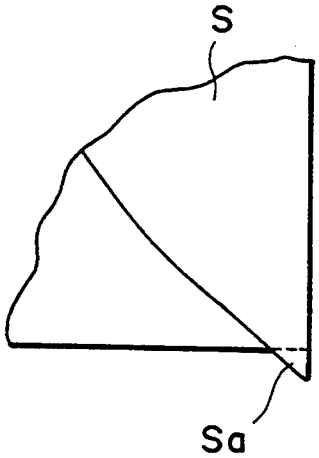

When an envelope is used as the sheet S, if the envelope is not correctly formed to create a protruded corner Sa as shown in FIGS. 12A and 12B, as the protruded corner Sa of the envelope S abuts against the separating pad 22, a great frictional resistance is generated. In such a case, conventionally, there arose problems that the envelopes S were not moved while abutting against the separating pad to prevent the separation thereof, and/or the envelope was skew-fed, and/or the separating pad 22 was damaged by the protruded corner Sa of the envelope to become the separating pad useless. Further, even if the envelope is correctly formed, since the corner of the envelope includes triple layers, and, thus is very hard, it was feared that, if the skew-fed envelope was abutted against the separating pad, the separating pad was damaged.

To the contrary, according to the illustrated embodiment of the present invention, since the width (L) of the separating pad 22 is narrower than the width (W) of the sheet $S_1$ ($L<W$) the corner of the sheet $S_1$ does not strike against the separating pad, thus preventing the damage of the separating pad 22 due to the corner of the sheet.

Then, the sheet $S_1$ contacts the upper guide of the paired guides 25, thus being guided toward the pair of feeding rollers 26 by means of the paired guides 25. Incidentally, as the leading edge of the sheet $S_1$ contacts the upper guide, the sheet $S_1$ is separated from the separating pad 22, thereby reducing the frictional resistance and preventing the wear of the separating pad 22. The sheet $S_1$ fed to the pair of feeding rollers 26 is pinched by the paired rollers 26 and is shifted thereby. Then, when a predetermined time period ($T_2$) is elapsed after the solenoid 51 is turned ON, the controller 55 turns the solenoid 51 OFF, thus disconnecting the driving force to the feed roller 16. Then, the sheet $S_1$ is fed into the laser beam printer 2 through the insertion opening 2*a* (above the cassette 3) by means of the pair of feeding rollers 26. In this case, although the trailing portion of the sheet $S_1$ is contacted by the feed roller 16, since the feed roller is disconnected from the driving source in this point and can be freely rotated through the one-way clutch, the feed roller 16 is rotated in response to the movement of the sheet caused by the paired rollers 26, thus not resisting the movement of the sheet.

Further, the sheet $S_1$ introduced into the laser beam printer 2 through the manual sheet insertion opening 2*a* is detected by the sheet presence sensor 34. The controller 55 receives a signal from the sensor 34, thereby executing an operation sequence same as a manual sheet feeding mode. In this case, when the trailing edge of the sheet $S_1$ is separated from the lamina 62, the latter lifts up the sheets $S_2$, $S_3$ by its returning force (reaction force), thus helping the separation of the sheet $S_1$ from the sheets $S_2$, $S_3$. Then, the sheet $S_1$ is fed to the image forming portion 100 (FIG. 1) by means of the feed roller 38. The sheet is then printed, and, thereafter, is ejected from the laser beam printer 2 onto the ejector tray 91.

As shown in FIGS. 8A, 8B and 9, the low friction sheet member 65 made of low friction material such as polyester sheet material is adhered to the upper end of the separating pad 22. A length (n) of the central portion of the sheet member 65 is shorter than those (m) of both end portions. With this arrangement, even when the sheet is skew-fed or when the sheet being fed is twisted, as one corner of the leading edge strikes against the one end portion of the separating pad 22, said one end portion of the separating pad is not subjected to a large force by the sheet. Further, an upper end portion 65*a* of the sheet member 65 is abutted against a back surface of a lower end portion 21*a* of the leading edge regulating member 21, whereby the sheet S tending to penetrate between the lower end portion 21*a* and the separating pad 22 is guided downwardly by the sheet member 65.

According to the illustrated embodiment, with the arrangement as mentioned above, when the thicker sheets S such as envelopes are supplied to the supply tray 6, the sheets S are fed by the feed roller 16 from the bottom in the same manner as mentioned above, and are separated one by one by means of the separating pad 22. The separated sheet is guided toward the pair of feeding rollers 26 by means of the pair of guides 25. Then, the sheet S is introduced into the laser beam printer 2 through the manual sheet insertion opening 2*a* by means of the pair of rollers 26. Thereafter, the sheet is fed to the image forming portion by means of the feed roller 38. The sheet is then printed, and, thereafter, is ejected out of the laser beam printer 2.

On the other hand, when the curled thicker sheets S are supplied to the supply tray 6, the lowermost sheet S is fed, by the feed roller 16, to the separating pad 22, where the sheet abuts against the low friction sheet member 65 at an angle larger than that in the case of the normal flat sheet. However, the low friction sheet member 65 has a low friction surface, the sheet S slides on the low friction sheet member 65 to be directed downwardly (refer to FIG. 9). When the leading edge of the sheet S abuts against the separating pad 22, an angle between the sheet S and the separating pad 22 is decreased to a value as same as an angle between the normal flat sheet and the separating pad. Consequently, the sheet S is correctly fed.

Figure 13:
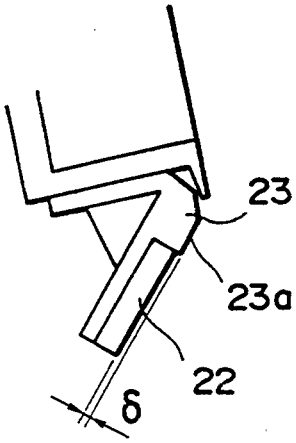
FIG. 13 is an enlarged view of the friction member.

Incidentally, in the illustrated embodiment, while an example that the low friction sheet 65 is used as a low friction member wad explained, the present invention is not limited to this example. For example, as shown in FIG. 13, the attachment plate 23 for attaching the separating pad 22 to the leading edge regulating member 21 may be molded by low friction material, whereby the sheet can be guided by an upper portion 23*a* (above the separating pad 22) of the attachment plate 23 toward the separating pad 22. In this case, a step δ may be created between the upper portion 23*a* and the separating pad 22 to prevent the curled sheet from being caught by the clearance between the upper portion 23*a* and the separating pad 22.

Figure 14:
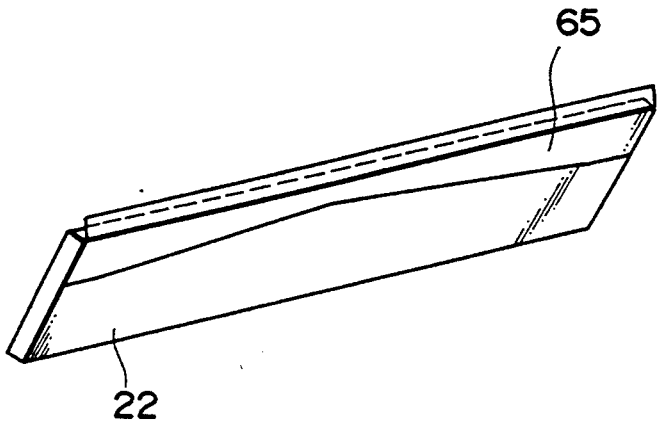
FIG. 14 is a perspective view of a friction member according to another embodiment.

Further, in the illustrated embodiment, while an example that the central portion of the low friction sheet member 65 is different in length from both end portions thereof was explained, the present invention is not limited to this example. For example, as shown in FIG. 14, the low friction sheet member may have a V-shaped edge or may have various profiles.

Further, in the illustrated embodiment, while an example that the feed roller is used as a feeder was explained, the present invention is not limited to this example. For example, in place of the feed roller, a feed belt may be used.

Figure 15:
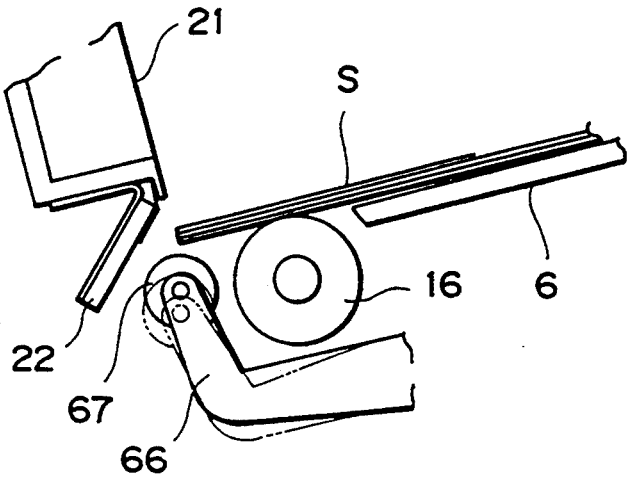
FIG. 15 is an elevational view showing a pressure means according to another embodiment.

Incidentally, in the illustrated embodiment, while an example that the lamina 62 is used as a pressure means was explained, the present invention is not limited to this example. For example, as shown in FIG. 15, a roller 67 rotatably supported by a rocking arm 66 may be used, which, when the sheet not hard to bend is separated, can be rocked in a position shown by a solid line to increase the pressing force of the roller 67 to the separating pad 22. In this case, when the sheet hard to bend is fed, the roller 67 and the rocking arm 66 are positioned as shown in a phantom line to decrease the pressing force of the roller 67 to the separating pad 22.

Figure 16:
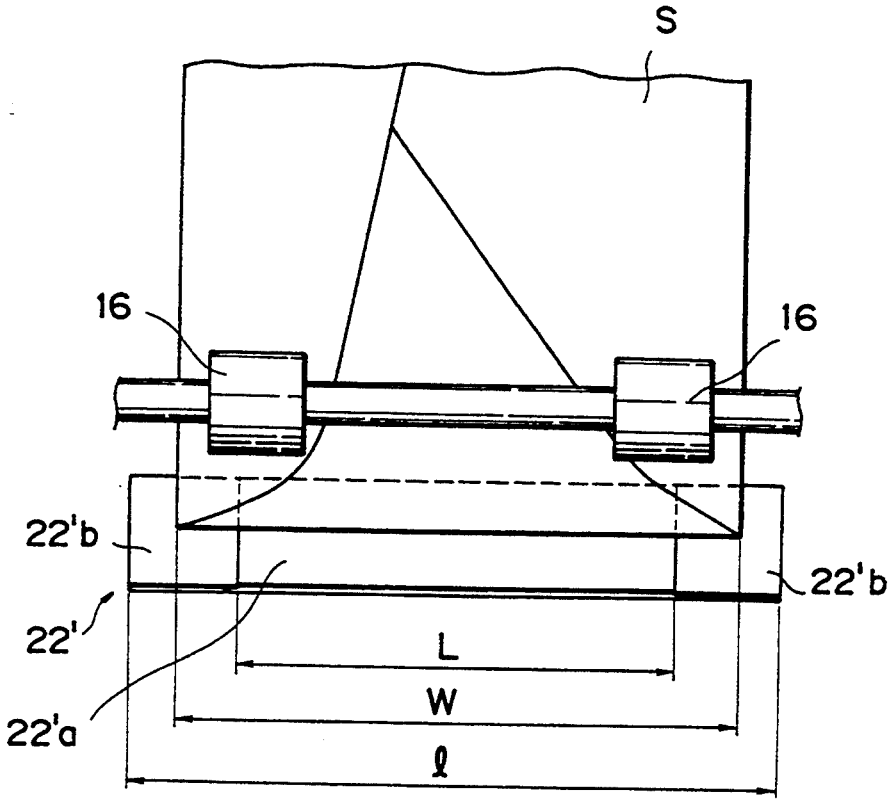
FIG. 16 is a plan view of a friction member according to a further embodiment.
Figure 17:
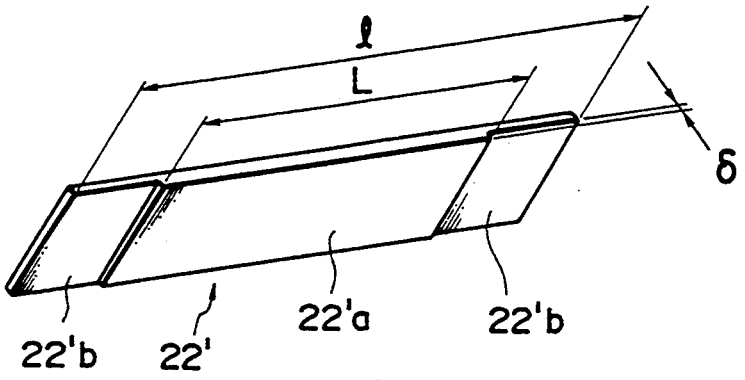
FIG. 17 is a perspective view of the friction member of FIG. 16.
Figure 18:
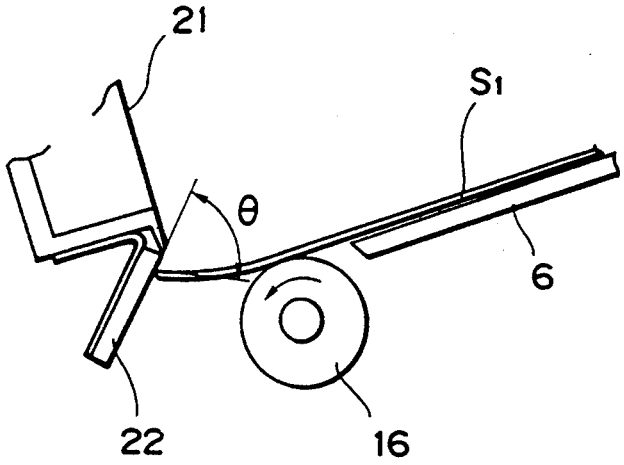
FIG. 18 is an explanatory view showing a condition that a curled sheet is fed.

Incidentally, in the illustrated embodiment, while an example that the width (L) of the separating pad 22 is shorter than the width (W) of the sheet S was explained, the present invention is not limited to this example. For example, as shown in FIGS. 16 and 17, a separating pad 22' may be used, which includes a central portion 22'*a* having a width L and contacting the sheet S, and both end portions 22'*b* lower than the central portion 22'*a* by a predetermined value δ and which has a predetermined total width l. With this arrangement, if the difference in the maximum width and the minimum width of the sheets to be handled is relatively great, the sheets having relatively small width can be separated by the area L of the separating pad, and the sheets having relatively large width can be separated by the area l by the utilization of the curvature of the sheet.

Further, in the illustrated embodiment, while an example that the sheets stacked in the supply tray 6 are fed from the bottom was explained, a roller for applying the sheet feeding force to the uppermost sheet so as to feed the sheets from the top may be used. In this case, the friction member are so inclined that an upper end thereof is positioned at a downstream side of a lower end thereof with respect to the sheet feeding direction.

We claim:

1. A sheet feeding apparatus comprising:

stacking means for stacking sheets;

feeding means for feeding out the sheets from said stacking means; and separating means for separating the sheets fed out by said feeding means one by one, said separating means comprising a friction member disposed inclined relative to a feed out direction of the sheets fed out by said feeding means for separating the sheets one by one by abutting a leading edge of the sheet fed out by said feeding means thereagainst, a guide member arranged upstream of said friction member at the same side of a sheet feeding path as said friction member for guiding the leading edge of the sheet fed out by said feeding means toward said friction member; and pressure means, arranged on the opposite side of said sheet feeding path from said friction member for urging the leading edge of the sheet fed out by said feeding means against said friction member.

2. A sheet feeding member according to claim 1, wherein said feeding means applies a sheet feeding force to a lowermost sheet among said stacked sheets.

3. A sheet feeding member according to claim 1, wherein said friction member is inclined so that an end thereof near said feeding means is positioned at a downstream of an end thereof near said stacked sheets with respect to said sheet feeding direction.

4. A sheet feeding member according to claim 3, wherein said guide member is arranged on an upstream end of said friction member.

5. A sheet feeding member according to claim 1, wherein said guide member comprises a low friction sheet member.

6. A sheet feeding member according to claim 5, wherein said low friction sheet member has a widthwise end portion extending toward the downstream of said sheet feeding direction longer than the other portion of said low friction sheet member.

7. A sheet feeding apparatus according to claim 1, wherein said pressure means comprises a plate-like member.

8. A sheet feeding apparatus according to claim 7, wherein said plate-like member is flexible lamina.

9. A sheet feeding apparatus comprising:

stacking means for supporting sheets;

feeding means for feeding out the sheets from said stacking means;

a friction member disposed inclined relative to a feed out direction of the sheets fed out by said feeding means for separating the sheets one by one by abutting a leading edge of the sheet fed out by said feeding means thereagainst; and a pair of guide members arranged upstream of said friction member on either side of a sheet feeding path for guiding the leading edge of the sheet fed out by said feeding means toward said friction member.

10. A sheet feeding apparatus according to claim 9, wherein one of said guide members comprises a low friction member for guiding the leading edge of the sheet fed out by said feeding means toward said friction member and the other of said guide members comprises a pressure member for urging the leading edge of the sheet fed out by said feeding means against said friction member.

11. A sheet feeding member according to claim 10, wherein said low friction sheet member has end portions along its width, both of the widthwise end portions extending toward the downstream of said sheet feeding direction longer than the other portion of said low friction sheet member.

12. A sheet feeding member according to claim 10, wherein said pressure means comprises a flexible lamina.

13. An image forming apparatus comprising:

stacking means for stacking sheets;

feeding means for feeding out the sheets from said stacking means;

separating means for separating the sheets fed out by said feeding means one by one, said separating means comprising a friction member disposed inclined relative to a feed out direction of the sheets fed out by said feeding means for separating the sheets one by one by abutting a leading edge of the sheet fed out by said feeding means thereagainst, a guide member arranged upstream of said friction member at the same side of a sheet feeding path as said friction member for guiding the leading edge of the sheet fed out by said feeding means toward said friction member, and pressure means, arranged on the opposite side of said sheet feeding path from said friction member for urging the leading edge of the sheet fed out by said feeding means against said friction member; and image forming means for forming an image on the sheet separated and fed out by said friction member.

14. An image forming apparatus according to claim 13, wherein said feeding means applies a sheet feeding force to a lowermost sheet among said stacked sheets.

15. An image forming apparatus according to claim 13, wherein said friction member is inclined so that an end thereof near said feeding means is positioned at a downstream of an end thereof near said stacked sheets with respect to said sheet feeding direction.

16. An image forming apparatus according to claim 13, wherein said guide member is arranged on an upstream end of said friction member.

17. An image forming apparatus according to claim 13, wherein said guide member comprises a low friction sheet member.

18. An image forming apparatus according to claim 13, wherein said low friction sheet member has a widthwise end portion extending toward the downstream of said sheet feeding direction longer than the other portion of said low friction sheet member.

19. An image forming apparatus comprising:

stacking means for supporting sheets;

feeding means for feeding out the sheets from said stacking means;

a friction member disposed inclined relative to a feed and direction of the sheets fed out by said feeding means for separating the sheets one by one by abutting a leading edge of the sheet fed out by said feeding means thereagainst;

a pair of guide members arranged upstream of said friction member on either side of a sheet feeding path for guiding the leading edge of the sheet fed out by said feeding means toward said friction member; and image forming means for forming an image on the sheet separated and fed out by said friction member.

20. An image forming apparatus according to claim 19, wherein said guide member comprises a low friction sheet member.

21. An image forming apparatus according to claim 19, wherein said low friction sheet member has end portions along its width, both of the widthwise end portions extending toward the downstream of said sheet feeding direction longer than the other portion of said low friction sheet member.

22. An image forming apparatus according to claim 19, wherein said pressure means comprises a flexible lamina.

* * * * *

UNITED STATES PATENT AND TRADEMARK OFFICE

CERTIFICATE OF CORRECTION

PATENT NO. : 5,441,250
DATED : August 15, 1995
INVENTOR(S) : TORU KAMEYAMA, ET AL.

It is certified that error appears in the above-indentified patent and that said Letters Patent is hereby corrected as shown below:

Column 1,
line 54, "are" should be deleted.
Column 6,
line 20, "sheet" should read --sheets--.
Column 7,
line 54, "as" (first occurrence) should read --the--; and
line 59, "wad" should read --was--.

Signed and Sealed this

Second Day of January, 1996

Bruce Lehman

BRUCE LEHMAN

*Commissioner of Patents and Trademarks*

*Attest:*

*Attesting Officer*

UNITED STATES PATENT AND TRADEMARK OFFICE

CERTIFICATE OF CORRECTION

PATENT NO. : 5,441,250

DATED : August 15, 1995

INVENTOR(S) : Toru Kameyama, et. al.

It is certified that error appears in the above-indentified patent and that said Letters Patent is hereby corrected as shown below:

Title page, item [73], Assignee: should read--Canon Kabushiki Kaisha, Tokyo, and Canon Aptex Inc., Mitsukaido, both of Japan--.

Signed and Sealed this

Twelfth Day of March, 1996

*Attest:*

Bruce Lehman

BRUCE LEHMAN

*Attesting Officer*

*Commissioner of Patents and Trademarks*